US005245389A

United States Patent [19]

Yoshiyama et al.

[11] Patent Number: 5,245,389

[45] Date of Patent: Sep. 14, 1993

[54] IMAGE FORMING APPARATUS

[75] Inventors: Tsugihito Yoshiyama, Toyohashi; Tadafumi Shimizu, Kurume; Hiroyuki Ideyama; Yoshihiko Hatta, both of Toyokawa; Masazumi Ito, Toyohashi, all of Japan

[73] Assignee: Minolta Camera Kabushiki Kaisha, Osaka, Japan

[21] Appl. No.: 798,140

[22] Filed: Nov. 26, 1991

[30] Foreign Application Priority Data

Nov. 27, 1990 [JP] Japan ..... 2-326983

[51] Int. Cl.[5] ..... G03G 21/00

[52] U.S. Cl. ..... 355/246; 355/208

[58] Field of Search ..... 355/208, 246, 204, 214

[56] References Cited

U.S. PATENT DOCUMENTS

| | | | |
|---|---|---|---|
| 4,542,985 | 9/1985 | Honma et al. | 355/208 |
| 4,592,646 | 6/1986 | Suzuki et al. | 355/214 |
| 4,885,466 | 12/1989 | Koichi et al. | 250/324 |
| 4,970,557 | 11/1990 | Masuda et al. | 355/246 |
| 5,053,814 | 10/1991 | Takano et al. | 355/208 |
| 5,057,867 | 10/1991 | Ishigaki et al. | 355/208 |

FOREIGN PATENT DOCUMENTS

| | | |
|---|---|---|
| 60-247271 | 12/1985 | Japan . |
| 63-296062 | 12/1988 | Japan . |

*Primary Examiner*—Leo P. Picard
*Assistant Examiner*—Christopher Horgan
*Attorney, Agent, or Firm*—Burns, Doane, Swecker & Mathis

[57] ABSTRACT

An image forming apparatus wherein the copying operation is performed not only in an automatic density specifying mode but also in a manual density specifying mode according to select by an operator. When the ratio of the frequency of select of the manual density specifying mode to the frequency of select of the automatic density specifying mode has exceeded a predetermined value, the image forming apparatus is adapted to execute an image adjustment process by detecting the state of components, for example, charge wires for the purpose of adjusting the density of copy images formed in the automatic density specifying mode.

10 Claims, 7 Drawing Sheets

IMAGE FORMING APPARATUS

BACKGROUND OF THE INVENTION

1. Field of the Invention

The present invention relates to an image forming apparatus for forming images on a recording medium by the electrophotographic process.

2. Description of the Related Art

The electrophotographic process has already found wide use in copying machines, facsimile systems, page printers and the like for forming images.

The electrophotographic process comprises the steps of uniformly charging the surface of a photosensitive member, exposing the surface of the photosensitive member to light in accordance with image data to form a latent image, developing the latent image with a toner image by depositing toner on the latent image, transferring the toner image onto recording paper, and fixing the transferred image to the paper.

Image forming apparatuses for practicing the electrophotographic process are adapted that when the power source is turned on, the operation values of various components or portions for determining the conditions for the process, such as the surface potential of the photosensitive member, amount of exposure and toner concentration, are set to initial values which are determined to give copy images of standard density.

Further copying machines, for example, have an operation key for specifying the density of copy images to be formed. With such a copying machine, electrophotographic process conditions, such as the amount of exposure, are altered according to the density specified. by the operation key, whereby copy images are formed with a density higher or lower than the standard density.

However, when used for a long period of time, the copying machine undergoes changes, which include adhesion of impurities to the photosensitive member, abrasion of the member, deterioration of the developer, deterioration of the exposure lamp, soiling of the optical system and alteration in the circuit constant of the control circuit.

For this reason, the conventional copying machine when used for a long period of time fails to produce copy images of standard density when components are set to initial operation values. More specifically, the copying machine has the problem of becoming unable to give a proper image density when the machine is set in the standard mode wherein no density adjustment is made by the operator.

This problem may be overcome by detecting various state values associated with the electrophotographic process conditions by suitable sensors every time a predetermined number of copies has been made or every time a predetermined period of time has elapsed and adjusting the process conditions based on the detected values for image adjustment.

Nevertheless, the time when image adjustment is made by detecting the state values with the sensors is not always the time when the image adjustment is needed. Consequently, the machine will be held out of copying operation while unnecessary image adjustment is executed and therefore still has the problem of being inefficient to use.

SUMMARY OF THE INVENTION

The main object of the present invention is to provide an image forming apparatus which is capable of producing copy images of proper density in the standard mode even if used for a prolonged period of time.

Another object of the invention is to provide an image forming apparatus adapted to produce copy images of proper density at all times by image adjustment executed at an appropriate time.

Still another object of the invention is to provide an image forming apparatus which is capable of performing an efficient copying operation.

These objects of the present invention are accomplished by an image forming apparatus comprising:

specifying means for specifying a desired image density, command means for commanding start of a copying operation, image forming means for forming an image on a recording medium, means for adjusting the density of the image to be formed by the image forming means, and control means for causing the image density adjusting means to execute image density adjustment when the ratio of the frequency of use of the specifying means to the frequency of use of the command means has exceeded a predetermined value.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DESCRIPTION OF THE PREFERRED EMBODIMENTS

Figure 3:
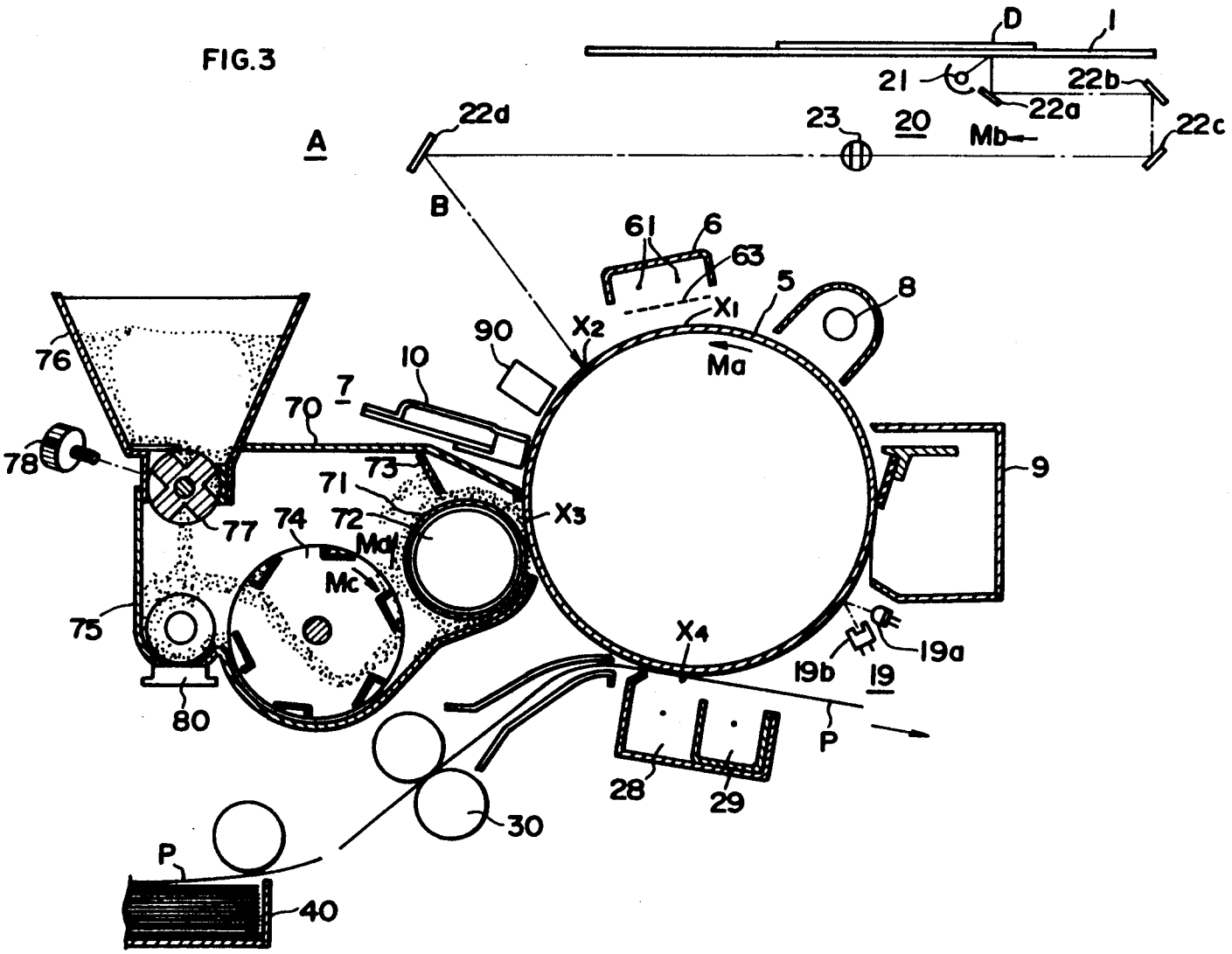
FIG. 3 is a fragmentary front view in section showing the copying machine.
Figure 4:
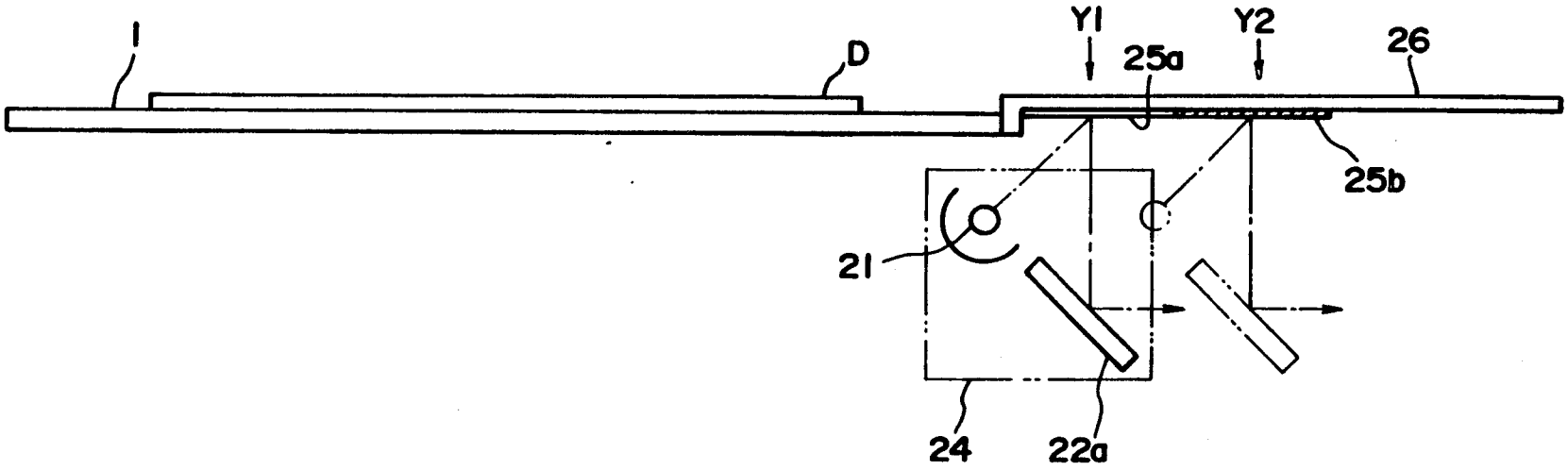
FIG. 4 is a fragmentary enlarged view showing an optical system.

With reference to FIG. 3 showing the main components of a copying machine A, a photosensitive drum 5 is disposed which is rotatable in the direction of arrow Ma at a constant peripheral speed v. Arranged around the photosensitive drum are a sensitizing charger 6, inter-image eraser 10, developing unit 7, transfer charger 28, separating charger 29, cleaner 9 and main eraser 8. Disposed between an exposure position X2 and the inter-image eraser 10 is a surface electrometer 90 for measuring the surface potential of the drum 5. Interposed between the separating charger 29 and the cleaner 9 is a reflective photosenser (AIDC sensor) 19 comprising a light-emitting element 19*a* and a photodetector 19*b* for measuring the density of a reference toner image.

The sensitizing charger 6 is a scorotron charger having charge wires 61 and a mesh grid 63. A constant high voltage is supplied to the charge wires 61 from a high-voltage transformer 62 which is on-off controlled by the CPU 201 to be described later. The amount of charges to be applied by the charge wires 61 to the surface of the drum 5 is controlled by controlling the potential of the grid 63, whereby the drum 5 is set to a desired surface potential. The surface potential of the drum 5 is settable stepwise to nine levels, i.e., levels 1 to 9, which are centered at level 5 as a standard and arranged at a voltage interval of 15 volts. For example ar level 5, the surface potential of the drum 5 is 650 volts. In the following description, the level to which the grid 63 of the sensitizing charger 6 is set will sometimes be referred to as "HV level."

The surface of the drum 5 is uniformly charged by passing a charging position Xl opposed to the charger 6, and is exposed to light at the exposure position X2 by an optical system 20. Some of the charges on the surface of the drum 5 are locally removed by the exposure, whereby a latent image corresponding to a document D is formed on the surface of the drum 5. The charges over the surface area other than the image area are erased by the inter-image eraser 10.

The optical system 20 comprises an exposure lamp 21 for illuminating the document D placed on a document support glass plate 1, mirrors 22*a* to 22*d* for guiding the reflected light from the document D to the exposure position X2, and a projection lens 23. During scanning of the document D with light, the exposure lamp 21 and the mirror 22*a* move in the direction of arrow Mb at a velocity v/m (wherein m is a copying magnification), while the mirrors 22*b*, 22*c* move at a velocity of v/2m.

The latent image formed on the surface of the drum 5 is developed by the developing unit 7 to a visible toner image.

Using a developer comprising a mixture of magnetic carrier and insulating toner, the developing unit 7 forms a known magnetic brush and deposits the toner on the latent image (over the unexposed area where charges are present) for normal development when the image passes a developing position X3. The unit 7 includes a developing tank 70 having arranged therein a developing sleeve 71 housing a magnetic roller 72, bristle height regulating plate 73, bucket roller 74 and screw roller 75. A toner concentration sensor (ATDC sensor) 80 is provided under the screw roller 75.

When the bucket roller 74 rotates in the direction of arrow Mc, the developer is attracted to the outer peripheral surface of the developing sleeve 71 magnetically by the magnetic roller 72 and transported to the developing position X3 with the rotation of the sleeve 71 in the direction of arrow Md. The ATDC sensor 80 measures the weight ratio T/C (wt %) of the toner to the whole developer from the magnetic permeability of the developer.

A toner hopper 76 provided at the top of the developing tank 70 has a toner, replenishing roller 77 at its bottom. When rotatably driven by a replenishing motor 78, the toner replenishing roller 77 supplies toner from the toner hopper 76 to the screw roller 75. The toner replenishment is then mixed with the developer already present within the tank 70 by being agitated by the rotation of the screw roller 75 and forwarded to the bucket roller 74. The agitation and mixing cause triboelectric charging, whereby the magnetic carrier and the toner are charged to polarities opposite to each other. At the developing position X3, the toner, which is of negative polarity, is electrostatically attracted by the surface charges of the photosensitive drum 5 and adheres to the surface of the drum 5. To prevent the adhesion of toner due to the charges remaining on the surface of the drum 5 (the charges remaining on the light-exposed area) at this time, a predetermined developing bias voltage VB is applied to the developing sleeve 71.

On the other hand, paper P delivered from a removable paper cassette 40 is transported as timed with the rotation of the drum 5 by a timing roller 30, and the toner image is transferred to the paper P at a transfer position X4 by the transfer charger 28. The paper P bearing the transferred toner image is acted on by the separating charger 29 for the removal of the charges and thereby separated from the drum 5. The paper is sent to an unillustrated fixing unit, which fixes the toner image to the paper P with heat and pressure.

The cleaner 9 thereafter removes residual toner from the surface of the drum 5. The main eraser 8 removes residual charges from the surface in preparation for the subsequent exposure.

Figure 5:
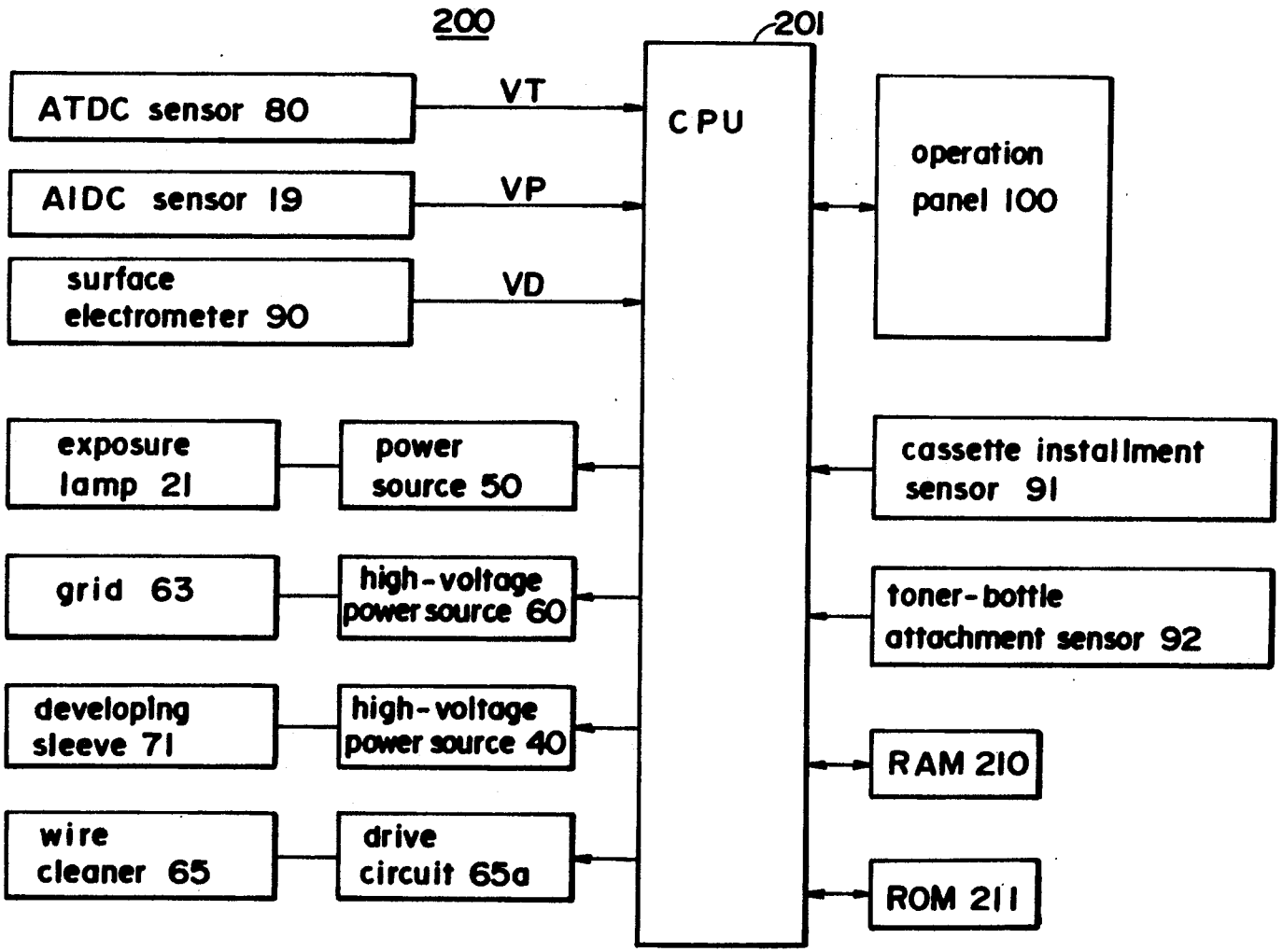
FIG. 5 is a block diagram showing a control circuit of the copying machine.

FIG. 5 is a fragmentary view showing the optical system 20 on an enlarged scale.

A slider unit 24 including the exposure lamp 21 and the mirror 22*a* is reciprocatingly movably disposed under the document support glass plate 1 for scanning the document D with light as described above during the copying operation. The unit 24 is brought to an adjusting position Y1 or Y2 for the adjustment of images to be described below.

Adjusting seals 25*a* and 25*b* corresponding to the adjusting positions Y1 and Y2, respectively, are affixed to the lower surface of the upper cover 26 of the body of the copying machine A. The adjusting seal 25*a* has a reflectance corresponding to the background area (white area) of usual document paper, while the adjusting seal 25*b* has a reflectance corresponding to a gray background area (halftone image).

FIG. 5 is a block diagram showing a control circuit 200 of the copying machine A.

The control circuit 200 comprises as its central component a CPU (central processing unit) 201 for controlling the copying machine A in its entirety.

The CPU 201 receives outputs from various sensors, such as an output voltage VT from the ATDC sensor 80, output voltage VP from the AIDC sensor 19 and output voltage VD from the surface electrometer 90. The CPU 201 feeds control signals to an exposure lamp power source 50 for turning on the exposure lamp 21, a high-voltage power source 60 for applying a high voltage to the grid 63, a high voltage source 40 for applying the developing bias voltage VB, etc. The CPU 201 has connected thereto other components, such as an operation panel 100, RAM 210 for storing various items of data for control and ROM 211 for storing programs and the like.

Figure 6:
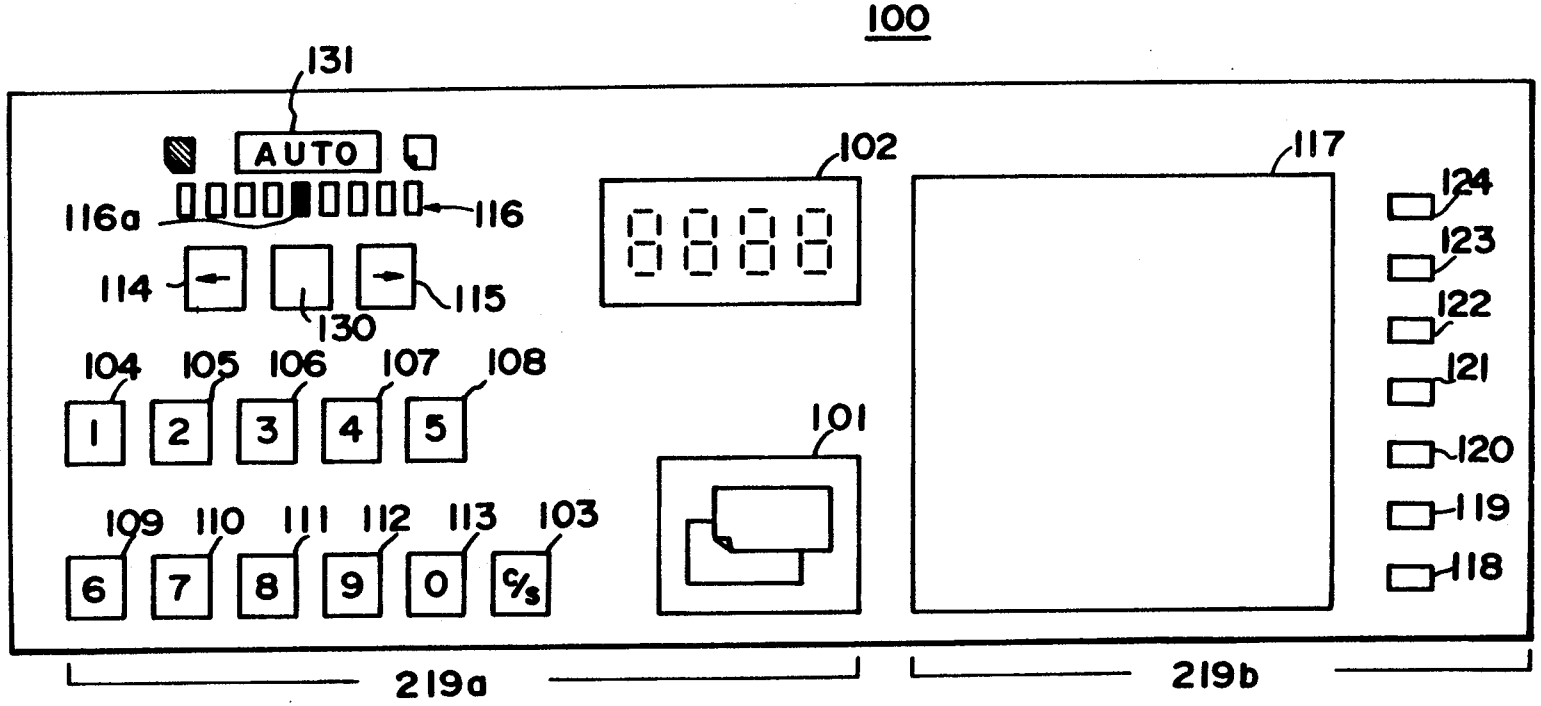
FIG. 6 is a plan view showing an operation panel of the copying machine.

FIG. 6 is a plan view showing the operation panel 100 of the copying machine A.

The operation panel 100 is divided into an operation portion 219*a* for setting copying conditions such as the number of copies, density of copies, etc., and a display-operation portion 219*b* relating to the indication of state of various components.

Arranged in the operation portion 219*a* are a print key 101 for starting a copying operation, sevensegment LEDs 102 for indicating the number of copies, etc., ten number entry keys 104 to 113 corresponding to the numerals of 1, 2, ..., 9, 0, respectively, a clearstop key 103 for cancelling the specification of copying conditions, up and down keys 114, 115 for specifying the density level of copies stepwise, a density indicator 116 for indicating the density level specified, a mode selection key 130 for effecting change-over between density specifying modes, etc.

Further arranged in the display-operation portion 219*b* are a message display 117 comprising a liquid crystal display, and serviceman keys 118 to 124.

The serviceman keys 118 to 124 are used chiefly by the serviceman for displaying or processing the control data stored in the RAM 210 and other maintenance work.

For initialization following the turning-on of the power source, an automatic density specifying mode is selected with a mode display LED 131 turned on. Every time the mode selection key 130 is depressed, one of the automatic density specifying mode and a manual density specifying mode is alternately selected. The automatic density specifying mode may be made changeable to the manual density specifying mode also when the up key 114 or down key 115 is depressed.

When the manual density specifying mode is selected for the operator to specify a desired density level, the mode display LED 131 goes off, and an LED 116*a* positioned in the center of the density indicator 116 and corresponding to a standard density alternatively goes on. Every time the up key 114 is depressed in this state, the density level rises stepwise from the standard density, lighting up the LEDs of the density indicator 116 one after another leftward from the central LED 116*a*. Alternatively, every time the down key 115 is depressed, the density level lowers stepwise, turning on the LEDs of the indicator 116 one after another rightward.

When a particular density level is specified in the manual density specifying the mode, the amount of exposure (EXP level) is altered according to the specified density level. More specifically, when the standard density level is set (when the LED 116*a* goes on), a standard value predetermined with reference to a case wherein standard documents (documents with black images on white paper) are copied is set as the EXP level. When darker images are to be formed, a value smaller than the standard value is set as the EXP level, whereas when lighter images are to be formed, a value greater than the standard value is set as the EXP level.

Incidentally, when no key is manipulated within a predetermined period of time after the manual density specifying mode has been selected, an autoresetting process executed by the CPU 201 automatically changes the mode to the automatic density specifying mode.

With the automatic density specifying mode selected, a copying operation is executed by a variation exposure method wherein the EXP level is adjusted in accordance with the amount of light reflected from the document D during exposure scanning, or by a fixed exposure method wherein the EXP level is set according to the overall density of the document D detected by prescanning. The operation produces a sharp copy image wherein the image area and the background area are apparently distinguished even if the document D is newspaper or a blue print of drawing having a dark background area or is a document written in pencil or like document having a light image area.

With the copying machine A thus constructed, the components thereof participating in the electrophotographic process are set to predetermined standard operation values. This permits the machine to operate under the standard conditions for the electrophotographic process to make copy images of proper quality.

However, if the copying machine A has been in use for a prolonged period of time, the components undergo changes due to the lapse of time. Consequently, the machine gradually becomes unable to produce copy images of proper quality if the set operation values remain the standard values. These changes include, for example, soiling of the charge wires 61 which leads to irregularities in images, and deterioration of the drum 5 or the developer which entails a reduced sensitivity or background fogging.

Aside from the alteration of the set operation values in conformity with the density level specified by the operator (hereinafter referred to as the "specification of density") as stated above, the copying machine A is therefore adapted to execute an image adjustment process by detecting the state of the components and determining proper values for the operation thereof in accordance with the result.

Although this process can be executed at a desired time, downtime during which the machine is held out of copying operation would then occur every time the process is practiced, consequently rendering the machine A less efficient to use. Accordingly, the process is practiced not at a time determined irrelevantly to the image quality but at a suitable time when the image quality has presumably become impaired actually as will be described below.

Figure 1:
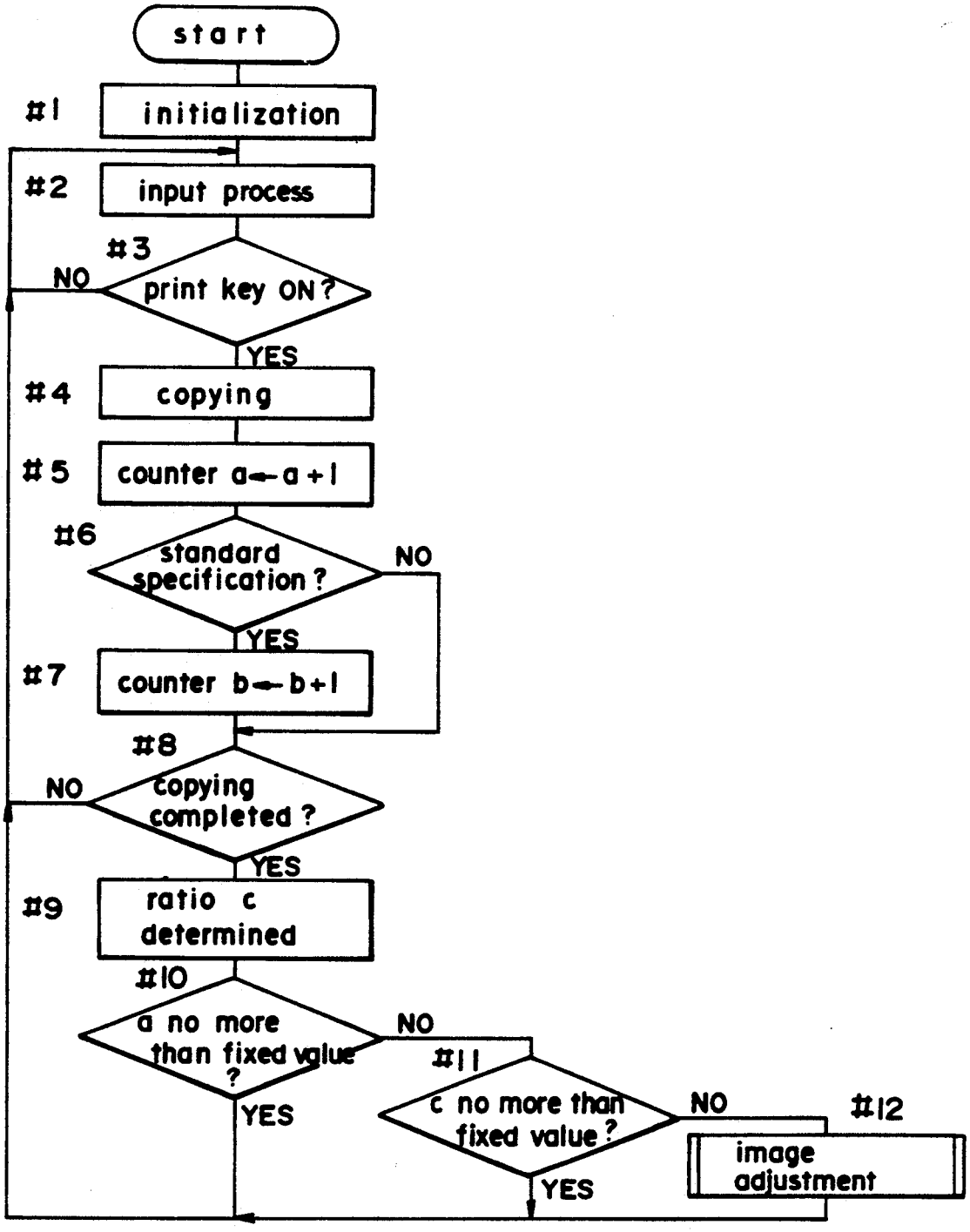
FIG. 1 is a main flow chart schematically showing the operation of a copying machine according to a first embodiment of the invention.

FIG. 1 is a main flow chart generally showing an example of operation of the copying machine A.

When the power source is turned on to start the contemplated program, the CPU 201 first initializes its components (step #1) and accepts signals from operation keys on the operation panel 100 and sensors for input processing (step #2).

Next, the print key 101 is checked as to whether it is on (step #3). If the print key 101 is found depressed, control for a copying operation is executed in accordance with the copying conditions, such as the number of copies, magnification and density, which are specified on the operation panel 100 (step #4).

The value on a copy counter a is incremented to count the number of times the print key 101 is depressed (step #5).

Before depressing the print key 101, the operator specifies the density level and like copying conditions. When the same density level as in the preceding copying cycle is to be specified at this time, the operator need not depress the key concerned, whereas admitting by the operator of the density level previously set is herein interpreted as a mode of specification of density. It therefore follows that the number of times the print key 101 is depressed, namely, the count value on the copy counter a, indicates the frequency of specification of density.

Subsequently, the specification of density included in the copying conditions and made before the depression of the print key 101 is checked as to whether it is standard specification (step #6). The term "standard specification" refers to a case wherein the operator specifies the automatic density specifying mode which is automatically selected upon the initialization of the present copying machine A as previously described, while a case wherein the manual density specifying mode is specified is referred to as "nonstandard specification."

When the standard specification has been made, the value on a standard density specifying counter b is incremented (step #7).

Thereafter, upon completion of the specified number of copies, a ratio of c represented by Equation (1) is determined (steps #8 and #9).

$$c=(a-b)/a \quad (1)$$

wherein a and b are count values on the copy counter a and the standard density specifying counter b, respectively.

Equation (1) reveals that the ratio c is the proportion of nonstandard specification in all instances of density specification. This value serves as an index for determining whether image adjustment is needed.

The manual density specifying mode is specified as nonstandard as stated above usually when the operator positively intends to adjust the image density as he desires or according to the density of the document D, whereas it is likely that the operator will use this mode negatively as an expedient in the case where a proper image quality is unavailable in the standard automatic density specifying mode. Accordingly, the frequency of nonstandard specification of density (the value of ratio c), if great, appears to indicate that there are many instances of negatively specifying the automatic density specifying mode. Thus, the great value of c can be interpreted as indicating the case of impaired copy image quality (need for image adjustment) due, for example, to the deterioration of some components participating in the electrophotographic process.

Accordingly, the CPU 201 executes the image adjustment process when the count value on the copy counter a is in excess of a predetermined value, with the ratio c exceeding a predetermined value (e.g., 0.4)(steps #10, #11 and #12).

Figure 2:
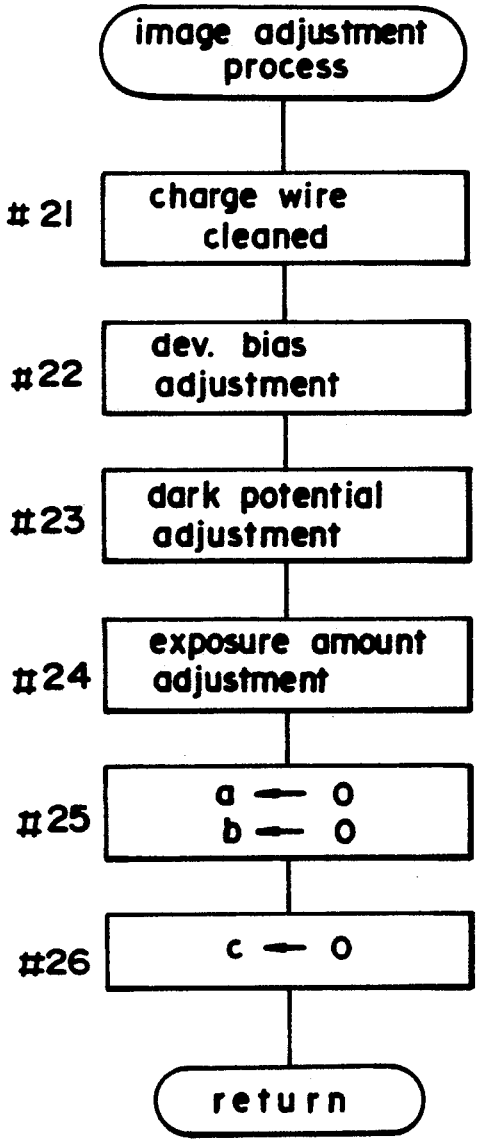
FIG. 2 is a flow chart showing an image adjustment process.

FIG. 2 is a flow chart showing the image adjustment process.

First, a wire cleaner 65 (FIG. 5) is operated to automatically clean the charge wires 61 (step #21), followed by steps #22 to #24 of adjusting the set operation values of components to make the electrophotographic process conditions proper .

Stated more specifically, the sensitizing charger 6 is turned on, and the surface potential VH of the photosensitive drum 5 is measured by the surface electrometer 90 with the exposure lamp 21 off. The potential of the grid 63 is then so adjusted that the surface potential VH becomes a standard value of the dark potential VO corresponding to the nonexposed area (black area) during copying.

Next, the slider unit 24 of the optical system 20 is moved to the aforementioned adjusting position Y1, the exposure lamp 21 is turned on to expose the drum 5 to the reflected light from the white adjusting seal 25*a*, and the residual potential (light potential) VR of the drum 5 is thereafter measured. The residual potential VR generally rises with the deterioration of the photosensitive drum.

The above-mentioned developing bias voltage VB is determined based on the residual potential VR. Equation (2) represents the optimum value of developing bias voltage VB in conformity with the standard electrophotographic process conditions which are determined by the configuration, material and the like of the photosensitive drum 5, the developing unit 7, etc.

$$VB=VO+100\ (V) \quad (2)$$

If the difference between the developing bias voltage VB and the residual potential VR becomes smaller than 100 volts, the toner adheres to the unexposed area, soiling the background. Conversely, if the difference becomes greater than 100 volts, the carrier in the developer adheres to the drum 5.

Subsequently, the slider unit 24 is moved to the adjusting position Y2, the drum 5 is exposed to the reflected light from the gray adjusting seal 25*b*, and the gray potential Vi of the drum 5 is thereafter measured. Further the latent image produced at this time is developed, and the density of the toner image obtained is measured with the AIDC sensor 19.

The ROM 211 has stored therein data showing the relationship between the output VP of the AIDC sensor 19 and the amount of deposited toner MT.

A developing efficiency $\gamma$ is determined from the data in the ROM 211 and Equation (3).

$$MT=\gamma(Vi-VB) \quad (3)$$

Next, the initial charge potential Vo of the drum 5 at the charging position Xl (see FIG. 3) is calculated from Equation (4) so that the amount of toner, MTo, to be deposited on the unexposed area will be optimum. The operation value of the sensitizing charger 6 to be set is determined in accordance with the initial charge potential Vo.

$$Vo=(MTo/\gamma)+VB \quad (4)$$

The slider unit 24 is thereafter moved to the adjusting position Y1 again, the drum 5 as charged to the initial charge potential Vo is exposed to light, and the resulting surface potential ViL of the drum 5 is measured. The voltage for turning on the exposure lamp 21 is determined to adjust the EXP level so that the surface potential ViL satisfies Equation (5).

$$ViL=VB-80(V) \quad (5)$$

In this way, the components are set to the adjusted operation values for producing images of proper quality. Thereafter, the copy counter a and the standard density specifying counter b are reset (step #25), and the register storing the ratio c is cleared.

Figure 7:
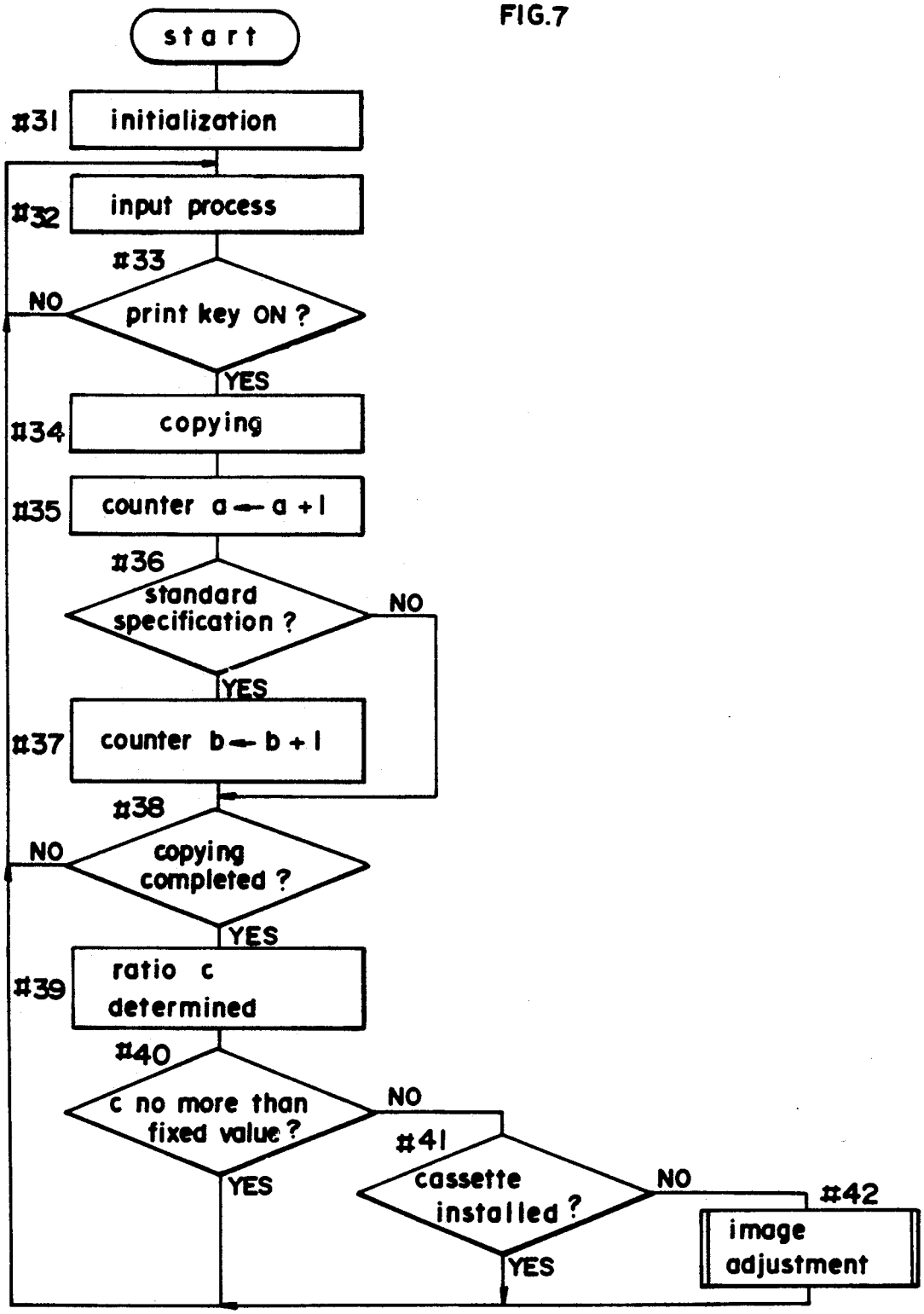
FIG. 7 is a main flow chart schematically showing the operation of a copying machine according to a second embodiment of the invention.

FIG. 7 is a main flow chart schematically showing the operation of another copying machine A as a second embodiment of the present invention. The construction of the second embodiment and the image adjustment process to be executed therein are the same as those of the first embodiment and therefore will not be described again.

Like steps #1 to #9 of FIG. 1, steps #31 to #39 are executed in succession for initialization, input processing, inquiry as to whether the print key 101 is on, copying, incrementing of the value on the copy counter a, checking of the specified density, incrementing of the value of the standard density specifying counter b, checking of completion of copies and calculation of the ratio c.

The ratio c is thereafter checked (step #40). If the ratio C is up to a predetermined value, the sequence returns to step #32.

Alternatively, when the ratio c is in excess of the predetermined value, an inquiry is made as to whether the paper cassette 40 has been installed in place (step #41). When the cassette 40 is not in place, image adjustment is executed (step #42).

In the foregoing embodiments, steps #11 and #12 or steps #41 and #42 to be executed by the CPU 201 correspond to the function of the image adjusting means of the present invention.

With the embodiments described above, the result of judgment by the operator as to the quality of images is reflected in determining whether image adjustment is necessary. This assures more timely image adjustment than when the adjustment is made at a time that is determined according to the period of use or the number of copies produced, consequently obviating downtime (period during which copying operation is prohibited) due to unnecessary image adjustment.

With the first embodiment described, the image adjustment is executed utilizing waiting time following the completion of a copying operation until the start of the subsequent copying operation, so that the downtime due to the execution of the adjustment can be minimized.

According to the second embodiment, the image adjustment is made utilizing a period of time during which the paper cassette 40 is removed for replacement or replenishment of paper P, i.e., downtime during which the machine is prohibited from copying. This will result in some delay in executing the image adjustment but serves to eliminate the downtime that would occur when the adjustment is made solely, consequently precluding a reduction in the efficiency of the copying machine A to be used.

With the embodiments described above, the operation panel 100 may be provided with an image adjustment cancel key for interrupting the image adjustment to cancel the prohibition of copying operation. The copying operation to be started after the interruption of the adjustment in this case can be conducted under the electrophotographic process conditions employed before the adjustment. The image adjustment is to be resumed after the completion of the copying operation.

The ratio c used in the foregoing embodiments as a standard value for determining whether the image adjustment is needed can be determined suitably, for example, based on statistical data as to the use of the machine.

Although the copying machine A described above and embodying the present invention is settable selectively in one of the automatic density specifying mode and the manual density specifying mode, the invention is applicable also to copying machines having the manual density specifying mode only. In this case, specifying the median of the variable density range, for example, can be standard specification of density, and specifying a value darker or lighter than the median can be nonstandard specification of density.

Further the adjustment of density need not be accomplished solely by varying the amount of exposure but may be realized by some other method, for example, by varying the developing bias value. Moreover, the image adjustment is not limited to the process of the embodiments but may be made with respect to a single component or by other combination of steps.

The present invention can be embodied as digital copying machines, laser printers and like image forming apparatus wherein the electrophotographic process is practiced.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus comprising:
specifying means for specifying a desired image density;
command means for commanding start of a copying operation;
determining means for determining the frequency of use of the specifying means and the frequency of use of the command means;
image forming means for forming an image on a recording medium;
varying means for varying conditions for image formation by the image forming means; and
control means for causing the varying means to vary the conditions for the image formation when the ratio of the frequency of use of the specifying means to the frequency of use of the command means has exceeded a predetermined value.

2. An image forming apparatus as claimed in claim 1 further comprising:
charging means for charging the surface of a photoreceptor, exposure means for exposing the photoreceptor surface charged by the charging means, developing means having a developing sleeve for developing an electrostatic latent image formed on the photoreceptor surface, and applying means for applying a bias voltage to the developing sleeve,
wherein the varying means varies each of the charging, exposing and applying means.

3. An image forming apparatus as claimed in claim 1 wherein the varying means varies the conditions for image formation when the frequency of use of the specifying means has exceeded a predetermined value.

4. An image forming apparatus as claimed in claim 1 wherein the varying means varies the conditions for image formation when a paper cassette has been removed from the body of the image forming apparatus.

5. An image forming apparatus comprising:
density control means for controlling the density of an image to be formed wherein the image is formed at one of a standard density level and a second density level other than said standard density level;
inputting means for inputting said second density level;
command means for commanding start of a copying operation;
determining means for determining the frequency of use of the inputting means and the frequency of use of the command means;
image forming means for forming an image under predetermined conditions at the standard density level; and modifying means for modifying said predetermined conditions every time an output of said determining means exceeds a predetermined level.

6. An image forming apparatus as claimed in claim 5 wherein the modifying means modifies the predetermined conditions when the ratio of the frequency of use of the inputting means to the frequency of use of the command means has exceeded a predetermined value.

7. An image forming apparatus as claimed in claim 6 wherein the modifying means modifies the predetermined conditions when the frequency of use of the inputting means has exceeded a predetermined value.

8. An image forming apparatus as claimed in claim 5 wherein the modifying means modifies the predetermined conditions when a paper cassette has been removed from the body of the image forming apparatus.

9. An image forming apparatus as claimed in claim 5 wherein the image forming means include charging means for charging the surface of a photoreceptor, exposure means for exposing the photoreceptor surface charged by the charging means, developing means having a developing sleeve for developing an electrostatic latent image formed on the photoreceptor surface, and applying means for applying a bias voltage to the developing sleeve.

10. A method performed in an image forming apparatus comprising the steps of:

specifying a desired image density;

commanding start of a copy operation;

determining the frequency of the specifying of the desired image density and the frequency of the commanding of the copy operation;

varying the image density when the ratio of the frequency of the specifying of the desired image density to the frequency of the commanding of the copy operation has exceeded a predetermined value.

* * * * *